US006513802B2

(12) United States Patent
Seger

(10) Patent No.: US 6,513,802 B2
(45) Date of Patent: Feb. 4, 2003

(54) QUICK CHANGE TOOLING SYSTEM FOR A VACUUM HOLDING FIXTURE FOR A THERMOFORMED PART

(75) Inventor: Anthony C. Seger, Sidney, OH (US)

(73) Assignee: Tooling Technology LLC, Huber Heights, OH (US)

( * ) Notice: Subject to any disclaimer, the term of this patent is extended or adjusted under 35 U.S.C. 154(b) by 139 days.

(21) Appl. No.: 09/801,316

(22) Filed: Mar. 7, 2001

(65) Prior Publication Data

US 2002/0124695 A1 Sep. 12, 2002

(51) Int. Cl.[7] ..... B25B 11/00

(52) U.S. Cl. ..... 269/21; 82/160; 269/20; 269/266; 269/309

(58) Field of Search ..... 269/21, 266, 309, 269/43; 279/121, 122, 50, 57; 294/86.4, 96, 64.1

(56) References Cited

U.S. PATENT DOCUMENTS 4,185,814 A * 1/1980 Buchmann ..... 271/108
4,773,839 A * 9/1988 Case ..... 425/186
5,322,719 A * 6/1994 Westling ..... 428/34.1
5,660,380 A * 8/1997 Reis ..... 269/21
5,722,646 A * 3/1998 Soderberg ..... 269/20
5,899,445 A * 5/1999 Kimble ..... 269/21

* cited by examiner

*Primary Examiner*—Joseph J. Hail, III
*Assistant Examiner*—Daniel Shanley
(74) *Attorney, Agent, or Firm*—Jacox, Meckstroth & Jenkins

(57) ABSTRACT

A vacuum holding fixture for a thermoformed part carries a base attachment plate which is releasably coupled to the top wall of a vacuum support box having a vacuum passage sealed to a vacuum passage within the attachment plate and a vacuum chamber within the holding fixture. The attachment plate is precisely positioned and releasably locked to the vacuum box by a plurality of couplers each including a stud projecting downwardly from the attachment plate and received within a corresponding cylinder recessed within the vacuum box. Each cylinder has locking balls which releasably grip the corresponding stud in response to axial movement of a fluid actuated spring biased piston surrounding the cylinder.

11 Claims, 2 Drawing Sheets

QUICK CHANGE TOOLING SYSTEM FOR A VACUUM HOLDING FIXTURE FOR A THERMOFORMED PART

BACKGROUND OF THE INVENTION

In the production of custom thermoformed articles or parts, such as parts produced by blow molding, vacuum molding, rotomolding, compression molding, resin transfer molding and reaction injection molding, it is usually necessary to perform one or more secondary operations on each part after it is formed. For example, the part may require peripheral trimming on a computer numerically controlled (CNC) router machine having a high speed router which is automatically moved around the base of the part to trim off an outwardly projecting flange. Commonly, each part is supported during the secondary trimming operation by a corresponding vacuum router fixture which receives the part and has small vacuum passages extending from an internal vacuum chamber within the fixture for positively holding the part firmly against the fixture. Each router fixture must be precisely positioned on the bed or table of the CNC router machine and then attached with clamps and/or bolts, after which the fixture is connected to a vacuum or suction line. These set up operations for the router fixture for each part require substantial time, and when it is necessary to perform trimming on a number of different thermoformed parts, several hours may be required for interchanging router fixtures and for precisely locating and positively securing or clamping each fixture to the router table. During this time period, the router machine is not operating, and the operator of the machine is not producing.

SUMMARY OF THE INVENTION

The present invention is directed to an improved quick change tooling system for a vacuum holding fixture which receives a thermoformed part in order to perform a secondary operation on the part, such as a peripheral trimming operation. The tooling system of the invention provides for quickly removing a vacuum holding fixture for a part from a machine which performs a secondary operation on the part and for quickly attaching another vacuum holding fixture for another part to the machine. As a result, down time of the machine and nonproductive time of the machine operator are minimized during set up for each fixture. The quick change tooling system of the invention further provides for quickly positioning each vacuum holding fixture on the machine and for positively locking the fixture to the base of the machine in a precise predetermined position, thus eliminating the use of hand tools, bolts, clamps and other fastening means. The tooling system also provides for quickly removing the vacuum holding fixture from the machine.

In accordance with one embodiment of the invention, an attachment plate is secured to the bottom surface of a vacuum holding fixture for a thermoformed part and has an opening which connects with a vacuum chamber within the fixture. The fixture is provided with an array of small vacuum passages connecting the internal vacuum chamber with the outer surfaces of the fixture. The attachment plate is adapted to seat on the top wall of a vacuum box which is connected by a line to a vacuum source. A resilient annular seal is mounted on the top wall of the vacuum box around a vacuum opening and forms an airtight seal between the vacuum opening in the attachment plate and the aligned vacuum opening within the top wall of the vacuum box.

A plurality or three air actuated locking couplers positively secure the fixture attachment plate to the vacuum box and precisely locate the vacuum fixture relative to the vacuum box which is secured to the bed or table of a machine. Preferably, each of the locking couplers includes a knob or stud projecting downwardly from the attachment plate and having an enlarged head portion which is received within a locking cylinder recessed within the top wall of the vacuum box. Each locking cylinder has circumferentially spaced balls for engaging the head portion of the corresponding coupler stud, and a spring loaded piston surrounds the balls and normally holds the balls in a locking position. The balls of all couplers retract to released positions in response to pressurized air simultaneously acting on the pistons of the couplers.

Other features and advantages of the invention will be apparent from the following description, the accompanying drawings and the appended claims.

DESCRIPTION OF THE PREFERRED EMBODIMENT

Figure 1:
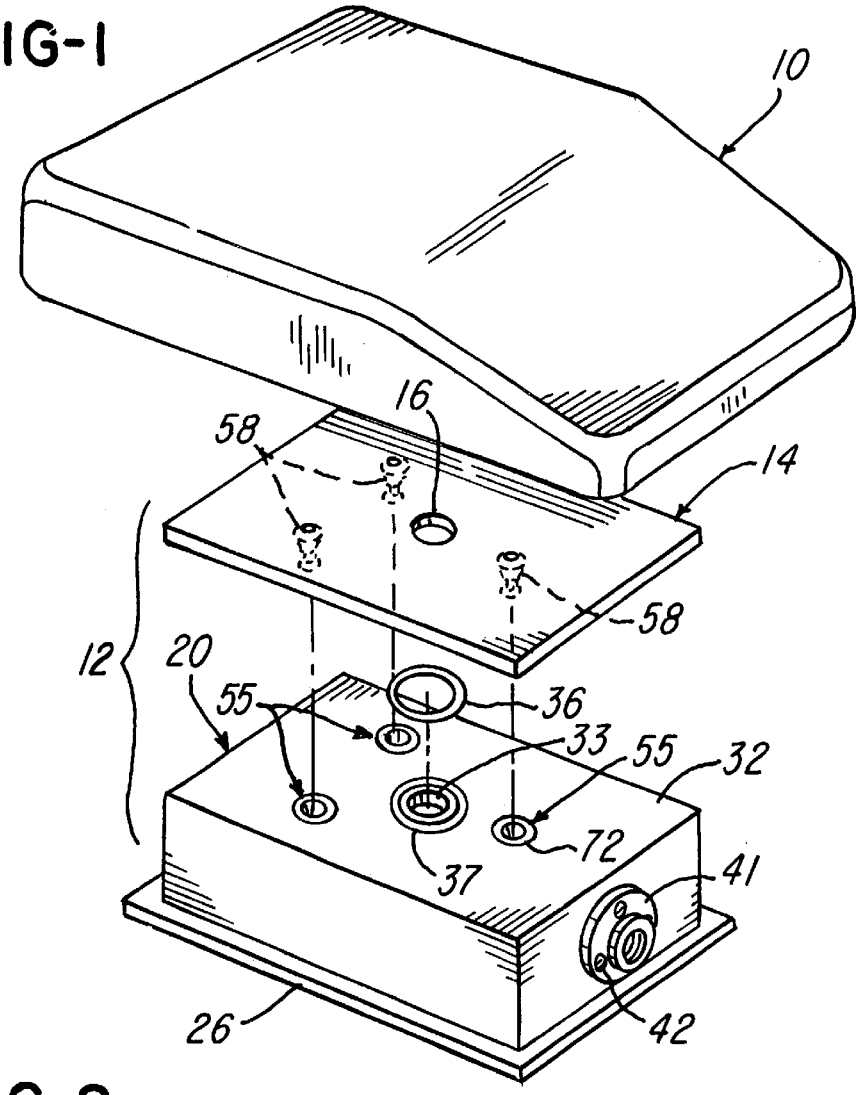
FIG. 1 is an exploded perspective view of a quick change tooling system constructed in accordance with the invention for precisely positioning and positively and releasably locking a vacuum holding fixture for a thermoformed part to a supporting vacuum box.

FIG. 1 illustrates a vacuum holding fixture 10 for a thermoformed part (not shown) and which typically supports the part on the base or table of a CNC router machine. The fixture 10 conforms to the shape of the part which extends over the top wall and around the opposite side walls and opposite end walls of the fixture. Commonly, the part has a laterally outwardly projecting peripheral base flange which is removed or trimmed by a numerically controlled router machine having a router bit which traverses around the periphery of the part while the part is supported by the vacuum holding fixture 10. Usually, the fixture 10 is cast of aluminum and defines an internal vacuum chamber (not shown) which is connected by small holes or passages to the outer surfaces of the fixture. When vacuum is introduced into the chamber of the fixture 10, the part is held firmly against the outer surfaces of the fixture.

Figure 2:
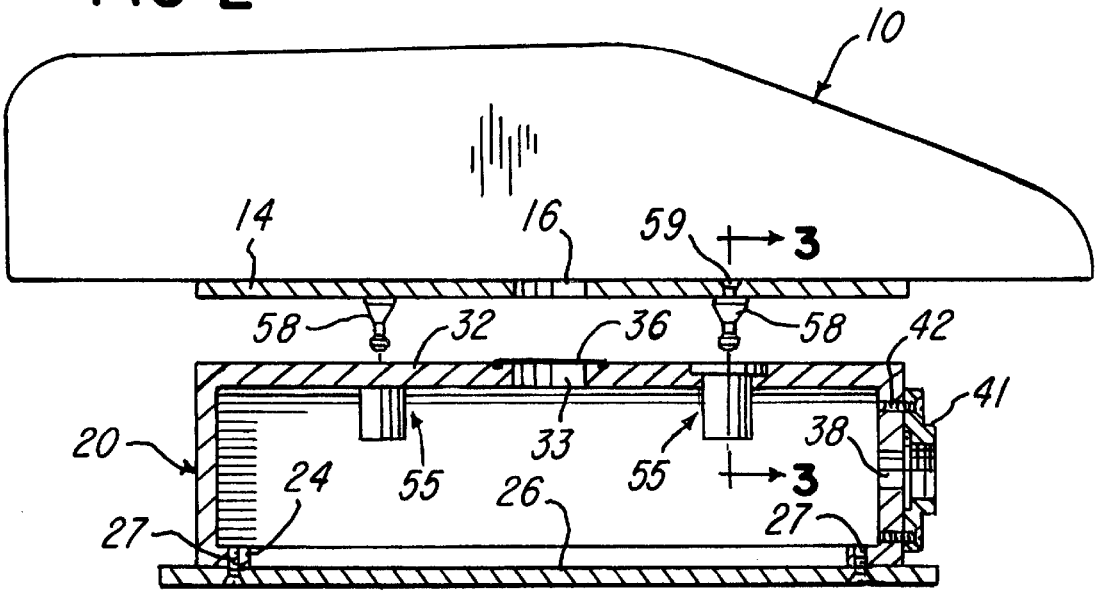
FIG. 2 is a section taken through the attachment plate and vacuum holding box shown in FIG. 1 and showing the alignment between the attachment plate and the vacuum box in a released position with the vacuum holding fixture elevated above the vacuum box.

In accordance with the present invention, a quick change tooling system 12 includes an attachment plate 14 which is secured to the bottom surface of the vacuum holding fixture 10 by a series of bolts or screws (not shown) and defines a center vacuum opening or port 16 which connects with the vacuum chamber within the fixture. However, it is understood that the configuration of the vacuum holding fixture 10 is for purpose of illustration only and that the quick change tooling system of the invention may be used with other vacuum holding fixtures of different configurations. As illustrated in FIG. 2, the attachment plate 14 is adapted for mounting and seating on a vacuum box 20 which is shown in the form of a cast aluminum housing 22 having an inwardly projecting base flange 24 secured and sealed to a base closure plate 26 by peripherally spaced screws 27.

The housing 22 has a top supporting wall 32 which has a center vacuum opening 33 positioned to be aligned with the vacuum opening 16 within the attachment plate 14. A resilient O-ring 36 is recessed within an annular groove 37 within the top wall 32 of the vacuum box 20 and surrounds the vacuum 35 opening 33 to form a fluid-tight seal between vacuum box and the attachment plate 14. An end wall of the vacuum box 20 has a vacuum port or opening 38 and receives a pipe coupling flange 41 which is secured by a set of screws 42.

The flange 41 threadably connects with a vacuum pipe or line which extends from a vacuum source (not shown).

The attachment plate 14 and the fixture 10 are releasably coupled and locked to the vacuum box 20 by a plurality of locking couplers 55 preferably of the type manufactured and sold by Edward D. Segen & Co., LLC of Shelton, Conn. and referred to in its catalog as a "Quick-Change Cylinder Lock".

Each of the three couplings 55 includes a male portion in the form of a metal knob or stud 58 which is secured by a screw 59 (FIG. 3) to the attachment plate 14 and projects downwardly from the attachment plate. Each knob 58 has a tapered or frusto-conical base portion 62 integrally connected to a head portion 63 by a neck portion 66 of reduced diameter.

Each of the couplings 55 also includes a female portion in the form of a cup-shaped cylinder 68 (FIG. 3) having a tapered internal surface 69 which mates with the tapered surface 62 of the stud 58. The cylinder 68 also has an outwardly projecting annular flange 72 which is received within a corresponding counterbore 74 within the top wall 32 of the vacuum box 20 and which is secured by peripherally spaced screws (not shown). Each of the coupler cylinders 68 also has an integral cup-shaped cylindrical portion 81 which defines a cavity for receiving the head portion 63 of the corresponding stud 58, and a plurality of hardened steel locking balls 83 are retained within corresponding circumferentially spaced holes within the cylinder portion 81 for corresponding radial movement.

Figure 3:
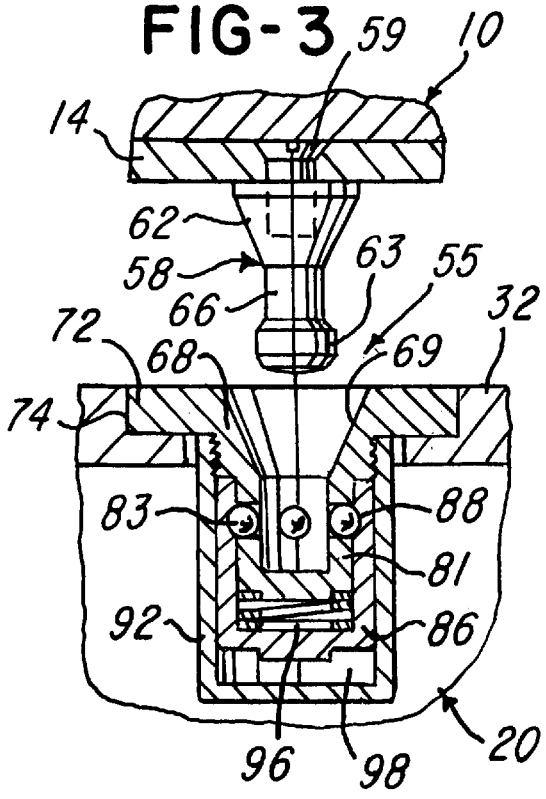
FIG. 3 is a fragmentary section taken generally on the line 3—3 of FIG. 2 and showing a locking coupler in its released position with the vacuum holding fixture elevated above the supporting vacuum box.
Figure 4:
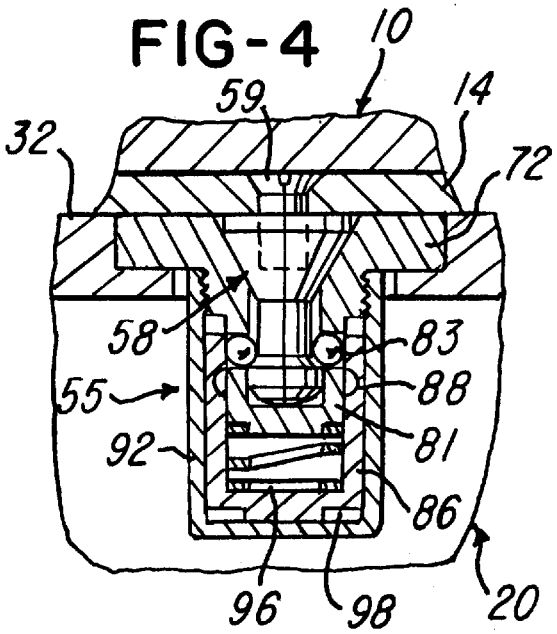
FIG. 4 is a fragmentary section similar to FIG. 3 and showing a coupler when the tooling system is in its coupled and locked position.

A cup-shaped piston 86 surrounds the portion 81 of the cylinder 68 and has a circumferentially extending internal groove or cavity 88 (FIG. 3) for receiving the balls 83 in their retracted positions when the piston 86 is in its released position (FIG. 3). A cylindrical cup-shaped housing 92 surrounds the piston 86 and has an upper end portion threadably connected to the cylinder 68. The housing 92 confines and supports the piston 86 for axial movement between an upper released position (FIG. 3) with the balls 83 retracted and a lower locked position (FIG. 4) when the balls 83 are cammed radially inwardly to engage the head portion 63 and neck portion 66 of the stud 58. A flat wire compression spring 96 normally urges the piston 86 downwardly to the locked position of the coupler 55 (FIG. 4). When it is desired to release each stud 58 from its cylinder 68, pressurized fluid or air is introduced into a chamber 98 defined below the piston 86 and within the housing 92 to force the piston upwardly against the bias of the spring to the released position (FIG. 3). In this position, the balls 83 move radially outwardly into the cavity or groove 88, allowing the stud 58 to be lifted and removed from its cylinder 68.

In operation of the quick change tooling system 12, the vacuum source to the vacuum box 20 is shut off, and pressurized air is simultaneously supplied to the chambers 98 of the locking couplers 55 so that the pistons 86 move upwardly allowing the locking balls 83 to shift to retracted and released positions, as shown in FIG. 3. The vacuum holding fixture 10 with its attachment plate 14 may then be lifted from the vacuum box 20 and replaced by another vacuum holding fixture with its corresponding attachment plate 14. After the next vacuum holding fixture and its attachment plate 14 are seated on the top wall 32 of the vacuum box 20, the air pressure within the chambers 98 of the couplers 55 is released or exhausted, and the compression springs 96 move the pistons 86 downwardly to cam the balls 83 inwardly to their locking positions, as shown in FIG. 4. When it is desired to replace one holding fixture with another holding fixture, the above steps for removing one fixture and replacing it with another fixture are repeated.

From the drawings and the above description, it is apparent that a quick change tooling system constructed in accordance with the invention, provides desirable features and advantages. For example, the tooling system provides for accurately and quickly positioning a vacuum holding fixture 10 on the bed or table of a CNC router and for positively and quickly locking the fixture to the bed or table. As a result, a change of fixtures or other tooling may be performed in only a few minutes so that down time of the router machine and the unproductive time of the machine operator are minimized. The quick change tooling system of the invention also eliminates the need for hand tools, bolts, clamps, shims and other such devices which are commonly used for precisely aligning and securing a router fixture on the table of a router machine. Moreover, as soon as the attachment plate 14 on the bottom of a fixture is seated on the top wall of the vacuum box 20, a vacuum may be introduced into the vacuum box 20 and the vacuum holding fixture 10 simply by opening a valve in the vacuum line.

While the form of quick change tooling system or apparatus herein described constitute a preferred embodiment of the invention, it is to be understood that invention is not limited to this precise form of apparatus, and that changes may be made therein without departing from the scope and spirit of the invention as defined in the appended claims.

What is claimed is:

1. A quick change tooling system adapted for use with a vacuum holding fixture for a thermoformed part, said system comprising an attachment plate having a vacuum opening and adapted to be secured to the bottom of the vacuum holding fixture, a vacuum box having a top wall for receiving and supporting said attachment plate and the vacuum holding fixture, said top wall of said vacuum box having an opening connected to said vacuum opening within said attachment plate, said vacuum box having a connection to a vacuum source, and a plurality of spaced releasable locking couplers securing said attachment plate to said top wall of said vacuum box.

2. A tooling system as defined in claim 1 wherein said opening in said top wall of said vacuum box aligns with said vacuum opening within said attachment plate, and a resilient sealing ring surrounding said openings and forming a vacuum seal between said vacuum box and said attachment plate.

3. A tooling system as defined in claim 2 wherein said top wall of said vacuum box has an annular groove surrounding said vacuum opening in said top wall, and said sealing ring is disposed within said groove.

4. A tooling system as defined in claim 1 wherein each of said locking couplers comprises a stud mounted on said attachment plate and having an enlarged head portion projecting downwardly from said plate, and a locking cylinder mounted on said top wall of said vacuum box and having a set of radially movable balls releasably engaging said head portion of said stud.

5. A tooling system as defined in claim 1 and including at least three of said locking couplers securing said attachment plate to said top wall of said vacuum box.

6. A tooling system as defined in claim 1 wherein each of said locking couplers comprises a cylinder having holes supporting a plurality of circumferentially spaced balls for corresponding radial movement, a downwardly projecting stud on said attachment plate and having an enlarged head portion, a piston supported around said cylinder and having a recess for receiving said balls in a released position, a spring urging said piston to a locked position with said balls engaging said head portion of said stud, and a housing supporting said piston and cooperating to receive fluid pressure for moving said piston to a released position with said balls received within said recess.

7. A quick change tooling system in combination with a vacuum holding fixture for a thermoformed part, said system comprising an attachment plate having a vacuum opening and secured to the bottom of the vacuum holding fixture, a vacuum box having a top wall receiving and supporting said attachment plate and said vacuum holding fixture, said top wall of said vacuum box having an opening connected to said vacuum opening within said attachment plate, said vacuum box having a connection to a vacuum source, a resilient seal surrounding said openings and forming a vacuum seal between said vacuum box and said attachment plate, and a plurality of spaced releasable locking couplers securing said attachment plate to said top wall of said vacuum box.

8. A tooling system as defined in claim 7 wherein said top wall of said vacuum box has an annular groove surrounding said vacuum opening in said top wall, and said seal comprises a sealing ring disposed within said groove.

9. A tooling system as defined in claim 7 wherein each of said locking couplers comprises a stud mounted on said attachment plate and having an enlarged head portion projecting downwardly from said plate, and a locking cylinder mounted on said top wall of said vacuum box and having a set of radially movable balls releasably engaging said head portion of said stud.

10. A tooling system as defined in claim 7 and including at least three of said locking couplers securing said attachment plate to said top wall of said vacuum box.

11. A tooling system as defined in claim 7 wherein each of said locking couplers comprises a cylinder having holes supporting a plurality of circumferentially spaced balls for corresponding radial movement, a downwardly projecting stud on said attachment plate and having an enlarged head portion, a piston supported around said cylinder and having a recess for receiving said balls in a released position, a spring urging said piston to a locked position with said balls engaging said head portion of said stud, and a housing supporting said piston and cooperating to receive fluid pressure for moving said piston to a released position with said balls received within said recess.

* * * * *